US005772120A

United States Patent [19]

Huber

[11] Patent Number: 5,772,120

[45] Date of Patent: Jun. 30, 1998

[54] MULTIFUNCTION HAND SHOWER

[75] Inventor: Roland Huber, Henschiken, Switzerland

[73] Assignee: Hansa Metallwerke AG, Stuttgart, Germany

[21] Appl. No.: 611,101

[22] Filed: Mar. 5, 1996

[30] Foreign Application Priority Data

Mar. 17, 1995 [DE] Germany ..... 195 09 661.4

[51] Int. Cl.[6] ..... B05B 1/18

[52] U.S. Cl. ..... 239/391; 239/447; 239/525; 239/DIG. 1

[58] Field of Search ..... 239/390, 391, 239/436, 438, 443, 444, 447, 548, 552, 554, 525, 586, DIG. 1

[56] References Cited

U.S. PATENT DOCUMENTS

| | | | |
|---|---|---|---|
| 4,203,550 | 5/1980 | On | 239/447 |
| 4,588,130 | 5/1986 | Trenary et al. | 239/447 |
| 4,629,124 | 12/1986 | Gruber | 239/447 |
| 4,629,125 | 12/1986 | Liu | 239/443 |
| 4,703,893 | 11/1987 | Gruber | 239/391 |
| 4,754,928 | 7/1988 | Rogers et al. | 239/447 |
| 4,838,486 | 6/1989 | Finkbeiner | 239/391 |
| 4,903,897 | 2/1990 | Hayes | 239/525 |
| 5,100,055 | 3/1992 | Rokitenetz et al. | 239/436 |
| 5,145,114 | 9/1992 | Monch | 239/447 |
| 5,356,077 | 10/1994 | Shames et al. | 239/447 |
| 5,356,078 | 10/1994 | Bischoff | 239/447 |

*Primary Examiner*—Andres Kashnikow
*Assistant Examiner*—Lisa Ann Douglas

[57] ABSTRACT

In a multifunction hand shower the mode of operation is selected by a change-over mechanism which has a slide (56) which has essentially linear movement. This can be set in three different positions. The slide (56) is connected via a guide and cam mechanism (62, 65) to a first change-over device (37) which can be moved into two different positions. The first position is adopted by the first change-over device (37) in the first mode of operation and the second position in the two other modes of operation. A second change-over device (45) can also be moved backwards and forwards between two positions which correspond to the second and a third mode of operation of the shower. Here, a spring (49) forces the second change-over device (45) into a preferred position. Whether the second change-over device (45) reaches this preferred position depends upon the position of a stop (59, 60) which is attached to the slide (56). The slide (56) is moved for preference by a rocker-type manual actuator (53).

16 Claims, 11 Drawing Sheets

MULTIFUNCTION HAND SHOWER

Figure 1:
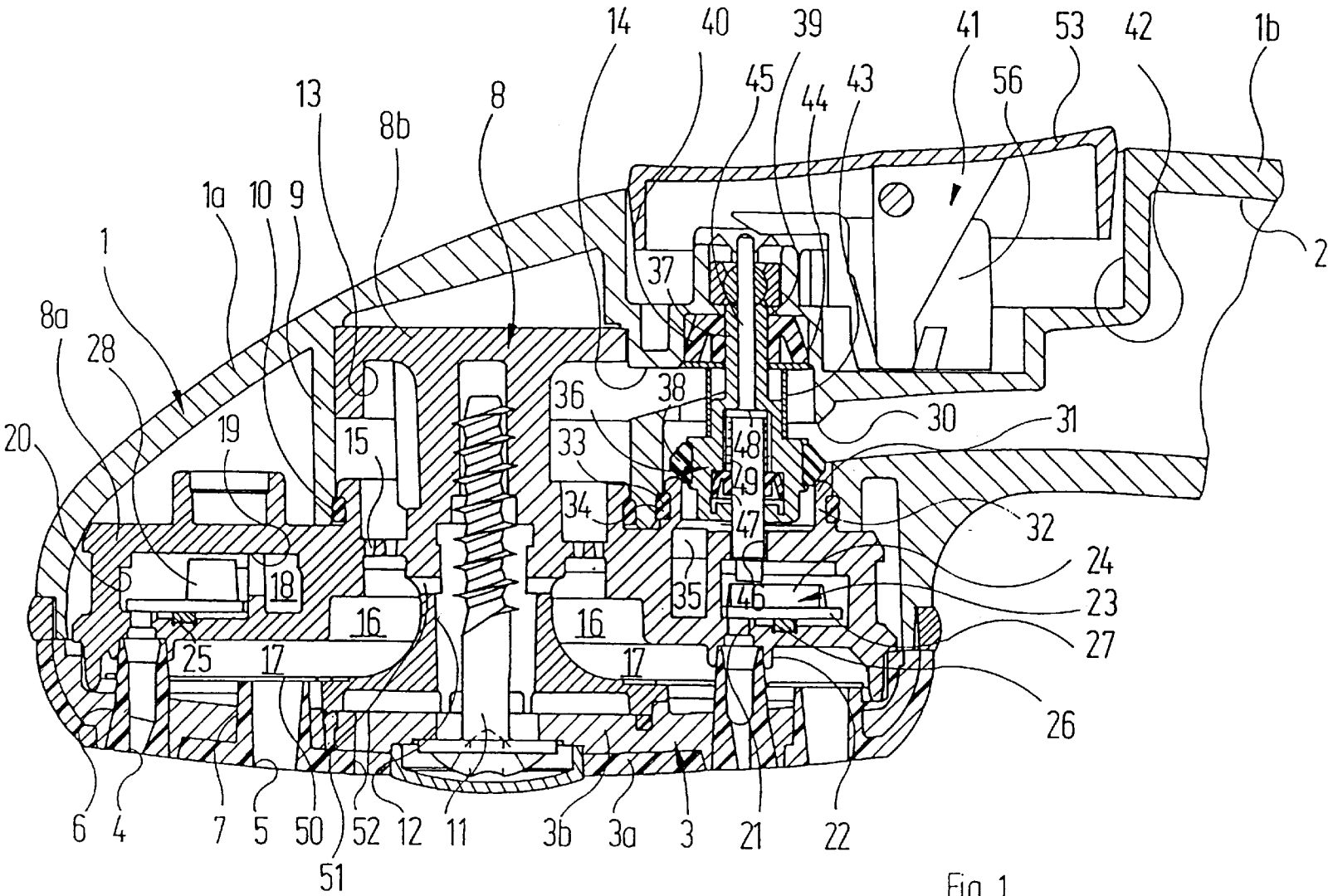

The invention concerns a multifunction hand shower in which three different modes of operation can be selected whereby different types of shower jets are produced, comprising a) a housing;

b) a shower base which seals the housing and which has a number of water outlet holes;

c) a change-over mechanism which is used to select the mode of operation and which consists of:

ca) a manual actuator;

cb) at least one change-over device controlled by the manual actuator, which can be moved into at least two different positions and hereby determines the mode of operation of the shower.

A "multifunction hand shower" is understood to mean a hand shower which can be used in several "modes of operation". Each of these "modes of operation" differs from the other in the character of the water jets which emerge from the shower base. The most well-known modes of operation are as follows: In "soft jet mode", the emerging jets of water have a relatively large cross-section; they are comparatively slow and are enriched with air. These jets are perceived by many users as being particularly pleasant and "soft". In the so-called "hard jet mode", the water jets which emerge from the shower base have a relatively small cross-section and are comparatively high speed; they are perceived by users as being "hard" and have an artificial massage effect. The latter mode can be intensified still further in the so-called "pulse jet mode" in which the hard jets are periodically interrupted. Irrespective of how the individual modes of operation are designed, any multifunction hand shower requires a change-over mechanism by which the user can set his desired mode of operation. Known multifunction hand showers are fitted with change-over mechanisms which users do not find easy to operate. Some of these change-over mechanisms are sited directly on the shower base and have to be operated by turning the shower base or one of the actuation rings which are concentric to this; sometimes there are several manual actuators when more than two modes of operation are provided.

The task of this invention is to design a multifunction hand shower of the type named at the beginning such that it is simple for the user to operate and can be housed inside the housing of the hand shower as a space-saving measure.

This task is solved according to the invention in that the change-over mechanism consists of:

cc) a slide which is contained in the housing and has translational or rotary motion controlled by the manual actuator and which can be set in three different positions corresponding to the modes of operation of the hand shower;

cd) a first change-over device which can be moved by means of the slide via a guide and cam mechanism into two different positions, the first of which sets the first mode of operation and the second of which sets the two other modes of operation;

ce) a second change-over device which can be set in two different positions and is pushed into these positions by means of a spring, whereby cf) the slide has a stop which, in one position of the slide, holds the second change-over device against the force of the spring in the first position and in a second position of the slide allows the spring to push the second change-over device into the second position.

The simple and straightforward operation of a multifunction hand shower according to the invention is achieved by an ingenious mechanism which uses two change-over devices which have a hierarchical relationship with each other. At the top of the hierarchy is a first change-over device which can be moved into two different positions by a slide which is contained in the change-over mechanism and which has linear motion. One of these positions corresponds to one of the three modes of operation; the other position is adopted in the two remaining modes of operation and the second control device is used to select either of these two modes of operation in a manner which will become clear later on. The transfer of force from the slide to the first change-over device occurs via a guide and cam mechanism. The second change-over device can also be set in two different positions but, according to the invention, one of these positions is made into a preferred position by means of a spring. Whether, however, this preferred position is achieved depends upon a stop which is also mounted on the slide. By correctly mounting the stop relative to the second change-over device, a differentiation can be made between the two corresponding modes of operation using the second change-over device, with the first change-over device in the second position. In one of these modes of operation, for example, the path of the second change-over device into the preferred position is free; in the other mode of operation, on the other hand, it is obstructed by the stop on the slide. The possible positions of the various components of the change-over mechanism according to the invention can therefore be summarized as follows:

| | |
|---|---|
| first mode of operation: | slide in first position;<br>first change-over device in first position;<br>second change-over device: position irrelevant; |
| second mode of operation: | slide in first position;<br>first change-over device in second position;<br>second change-over device in first position in which the stop on the slide obstructs any advance into the second position; |
| third mode of operation: | slide in third position;<br>first change-over device in second position;<br>second change-over device in second position in which the stop on the slide allows the second change-over device to be moved forward into this position. |

The design of change-over mechanism according to the invention is easy for a user to understand because only one single manual control device is provided which can be set in three positions which clearly relate to the three modes of operation. The mechanism can be built into the housing and is thus very space saving.

In a preferred embodiment of the invention, the first change-over device acts upon a two-way valve cone which works in concert with two valve seats formed in the housing. This two-way valve cone is therefore able to distribute the water flowing through the hand set of the hand shower to two water channels: the first water channel leads to devices built into the housing of the shower which enrich the water with air and from there to relatively large water outlet openings. The jets produced are soft jets. The other water channel is designed for both of the modes of operation in which hard jets or pulsed hard jets are produced and either of these two modes of operation can be selected by means of the second change-over device.

To achieve this, for example, provision can be made for the second change-over device to also act upon a two-way valve cone which acts in concert with a third and a fourth valve seat formed in the housing. The two modes of operation which produce hard shower jets are then once again differentiated by distributing the water into two different water channels inside the housing.

For expedience, this happens in such a way that the side of the third and fourth valve seat which is located upstream connects with the side of the first or second valve seat sited downstream.

It is commonly known that in order to achieve "pulse jets" in hand showers, a pulse wheel which is pivot mounted in the housing is rotated in the appropriate mode of operation and in so doing periodically interrupts the emerging jet's of water. This can be achieved, for example, by providing two different water channels inside the housing of the hand shower for hard jet and pulse jet operation, whereby the pulse wheel is positioned in one of these water channels and one of these water channels is selected using the two-way valve cone controlled by the second change-over device as described above.

A very much more preferred embodiment is one according to the invention where the second change-over device acts upon a stop component which in one of the two positions of the second change-over device is located outside the path of movement of a stop mounted on the pulse wheel and in the other of the two positions of the second change-over device is located in the path of movement of the stop on the pulse wheel such that the pulse wheel stops in a defined position of rotation. By virtue of this configuration, only one single water channel is required inside the shower for both the hard jet and the pulse jet modes. Consequently, the jet pattern presented by a hand shower of this type in the hard jet and pulse jet mode is identical (apart from the interruption of the water jet in pulse mode). Unlike in the designs in which separate water channels are provided for hard jet and pulse jet modes, the number of water jets which emerge in both modes of operation can be kept high.

It is geometrically expedient if the two change-over devices can be moved parallel to each other and perpendicular to the direction of movement of the slide. It is a simple matter to move the slide parallel to the wall of the housing of the hand shower. Any movement of the change-over device which is perpendicular to this then leads into the housing where the moving components are to be found.

An especially space-saving design is one in which the second change-over device is carried coaxially inside the hollow first change-over device. This configuration can then also be used simply for obstructing the movement of the second change-over device in the first position of the first change-over device by means of corresponding stops.

In the configuration of a hand shower according to the invention, the manual actuator can be a rocker which can be moved clockwise from a centre first position into a second position and anticlockwise into a third position. The use of rockers as control devices in sanitary equipment is actually well-known and common because they are simple to operate and can be housed on the appropriate sanitary components in a visually pleasing manner. However, the commonly known rockers have only two different positions of rotation, whilst in the design of hand shower according to the invention the rocker also has a centre position.

The forces can be transferred from the rocker to the slide by means of an actuating finger which is preformed on to the rocker which engages in a guide recess of the slide. The rotational movement of the actuating finger on the rocker can thus be simply converted into a linear motion of the slide.

A particularly preferred embodiment of the invention is one in which the guide and cam mechanism operates symmetrically relative to the centre position of the slide, whereas the stop on the slide operates asymmetrically relative to the centre position of the slide in the sense that it obstructs the movement of the second change-over device into the second position in only one of the out-of-centre positions of the slide. In this embodiment of the invention, the centre position of the slide therefore corresponds to the first mode of operation in which the first change-over device adopts its first position. Irrespective of the direction into which the slide is now moved from this centre position, the first change-over device is always moved into the second position by virtue of the symmetrically designed guide and cam mechanism. Given, however, that the direction of movement of the slide from the centre position into the two out-of-centre positions occurs in opposite directions, it easy to ensure, from a geometrical point of view, that the stop on the slide engages on the second change-over device in one of these out-of-centre positions and retains it in its first position, whereas in the second out-of-centre position it frees the second change-over device and allows it to advance into its preferred position.

A symmetrically operating guide and cam mechanism of this type can be achieved most simply by a or several V-shaped guide slot(s) working in concert with a or several guide pin(s) on the first change-over device. In the centre position of the slide, each guide pin is located in the apex of the corresponding V. Any lateral movement of the slide then forces the guide pin along the corresponding side of the V so that a corresponding movement of the first change-over device into the same direction occurs, irrespective of the direction in which the slide is moved from the centre position.

It is expedient if the first change-over device consists of:

a) a shaft part with a partially spherical head;

b) a guide ring with a partially spherical interior space in which the partially spherical head of the shaft part is housed, in such a way that it is form fit but is capable of rotation.

This configuration allows the first change-over device to be rotated so that in the case of any misalignment and angle errors inside the housing there is no risk that the first change-over device will be obstructed.

The stop on the slide can, for expediency, be formed by an arm which projects from the slide perpendicular to the direction of movement of the second change-over device. This arm then overlaps the free end of the second change-over device in the position in which this is required to be held against the force of the spring in the first position.

A cam surface set at an angle to the direction of movement of the slide can be mounted on the free end of the arm. If, therefore, the slide is moved back from the out-of-centre position corresponding to the second position of the second change-over device into the centre position, then the second change-over device is forced back into its first position against the force of the spring with the aid of the inclined cam surface.

Figure 2A:
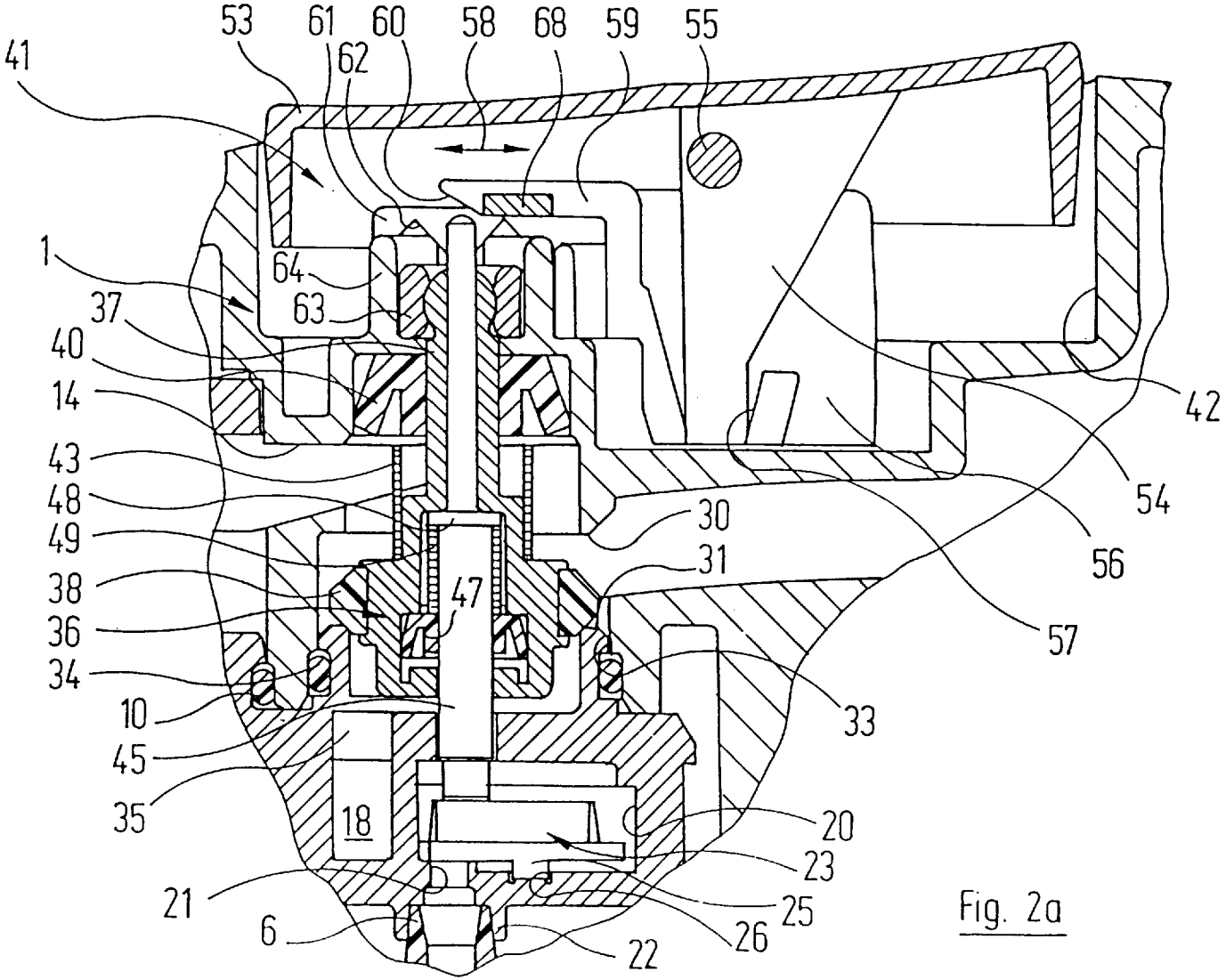
Figure 2B:
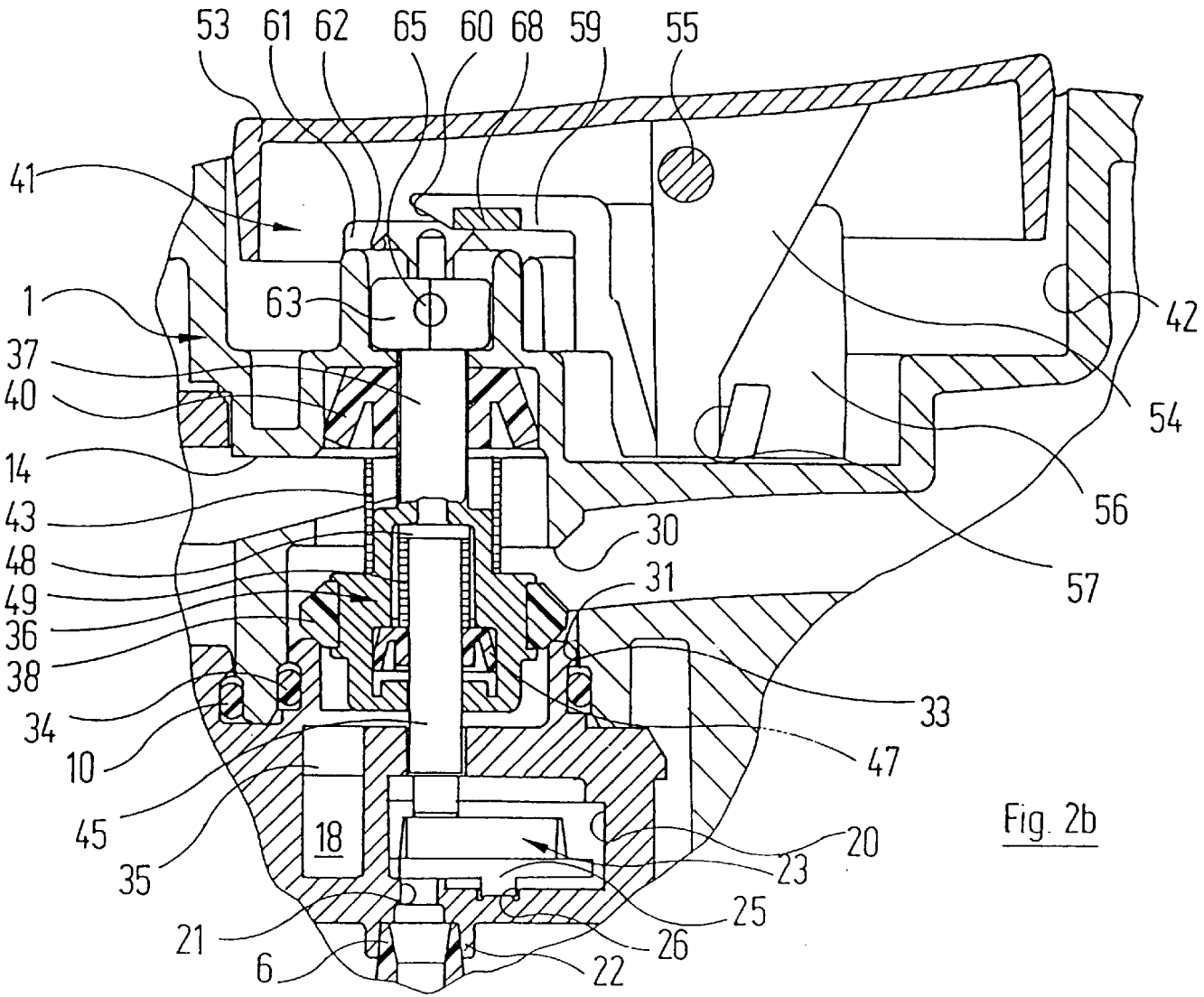
Figure 2C:
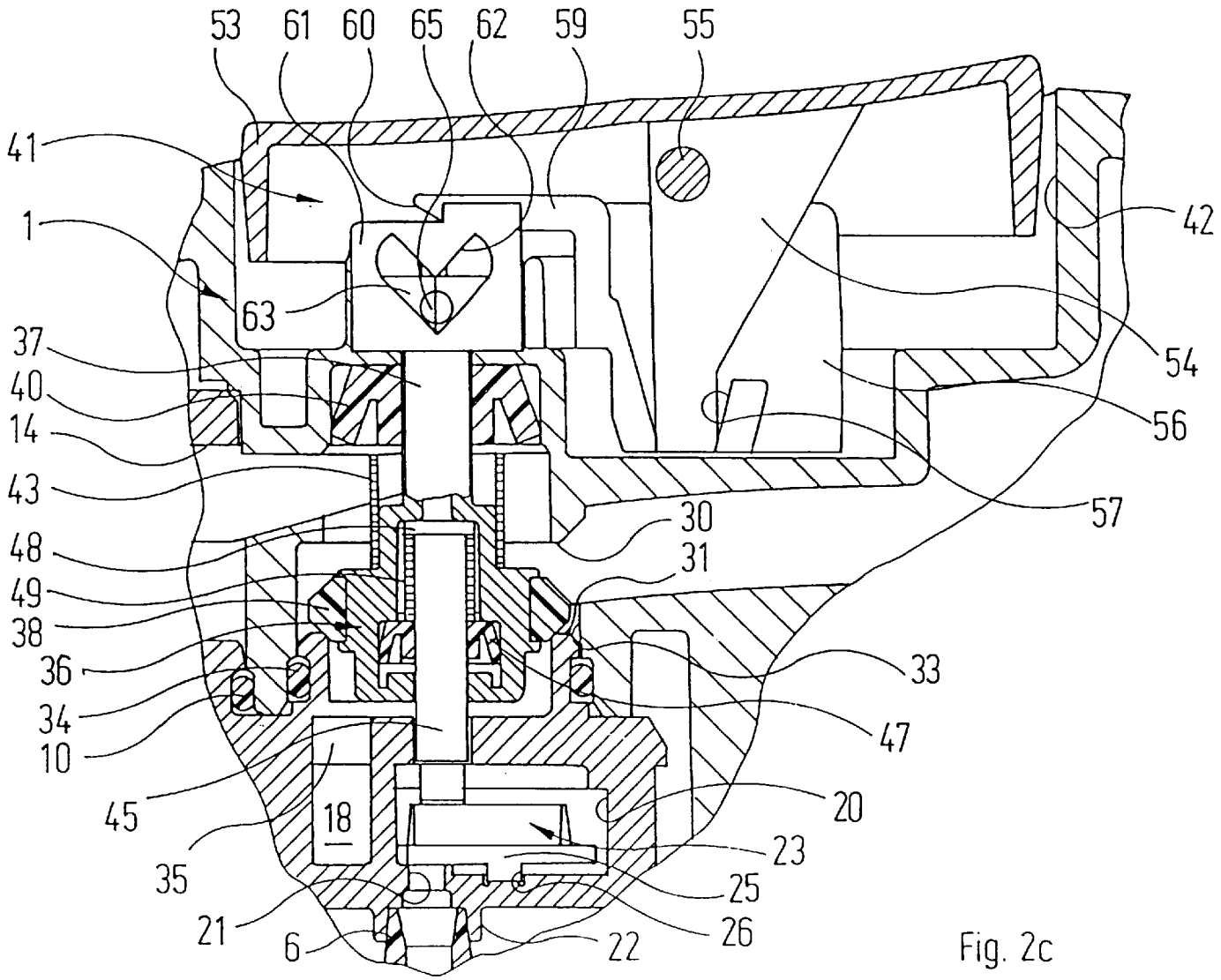
Figure 3A:
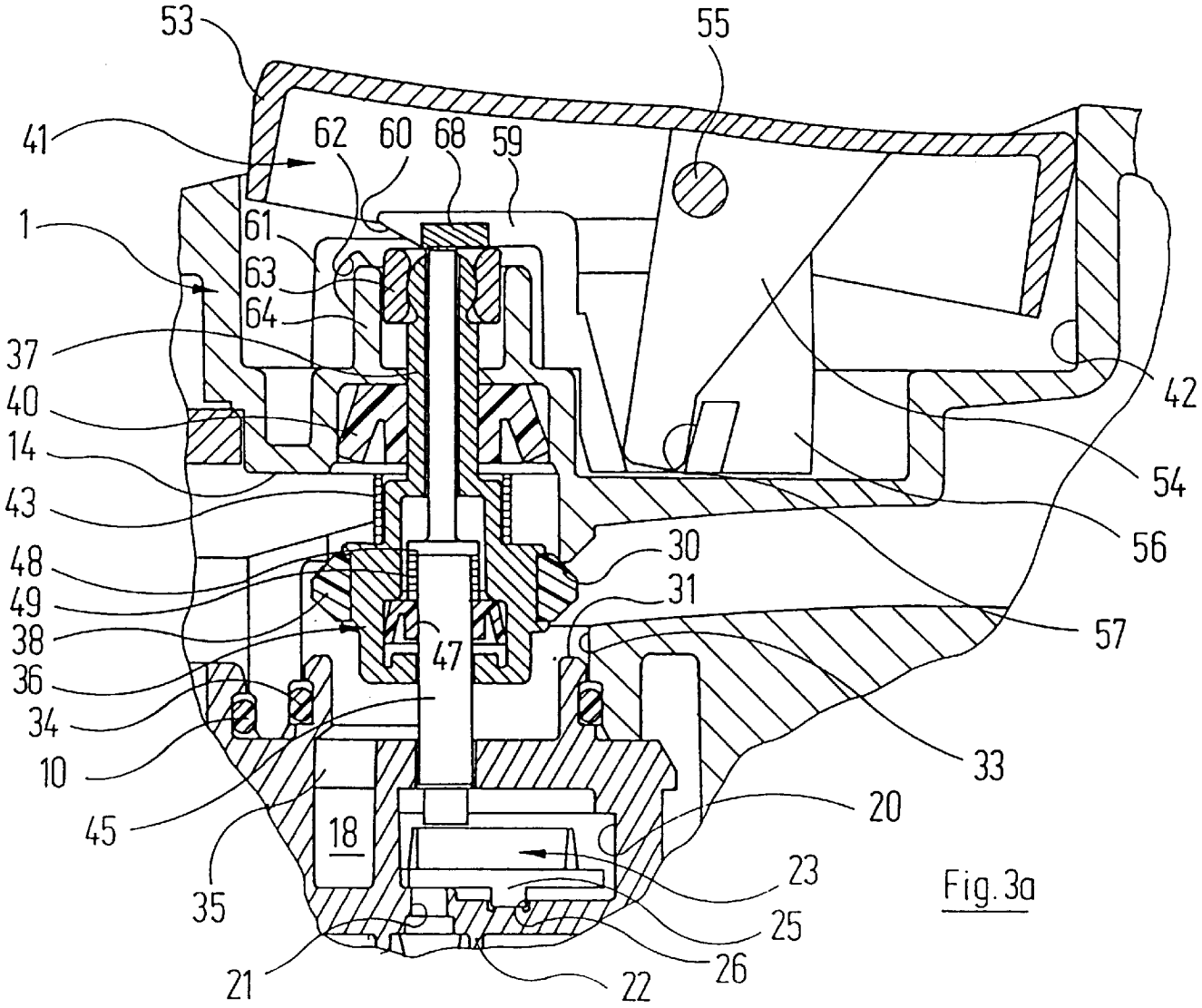
Figure 3B:
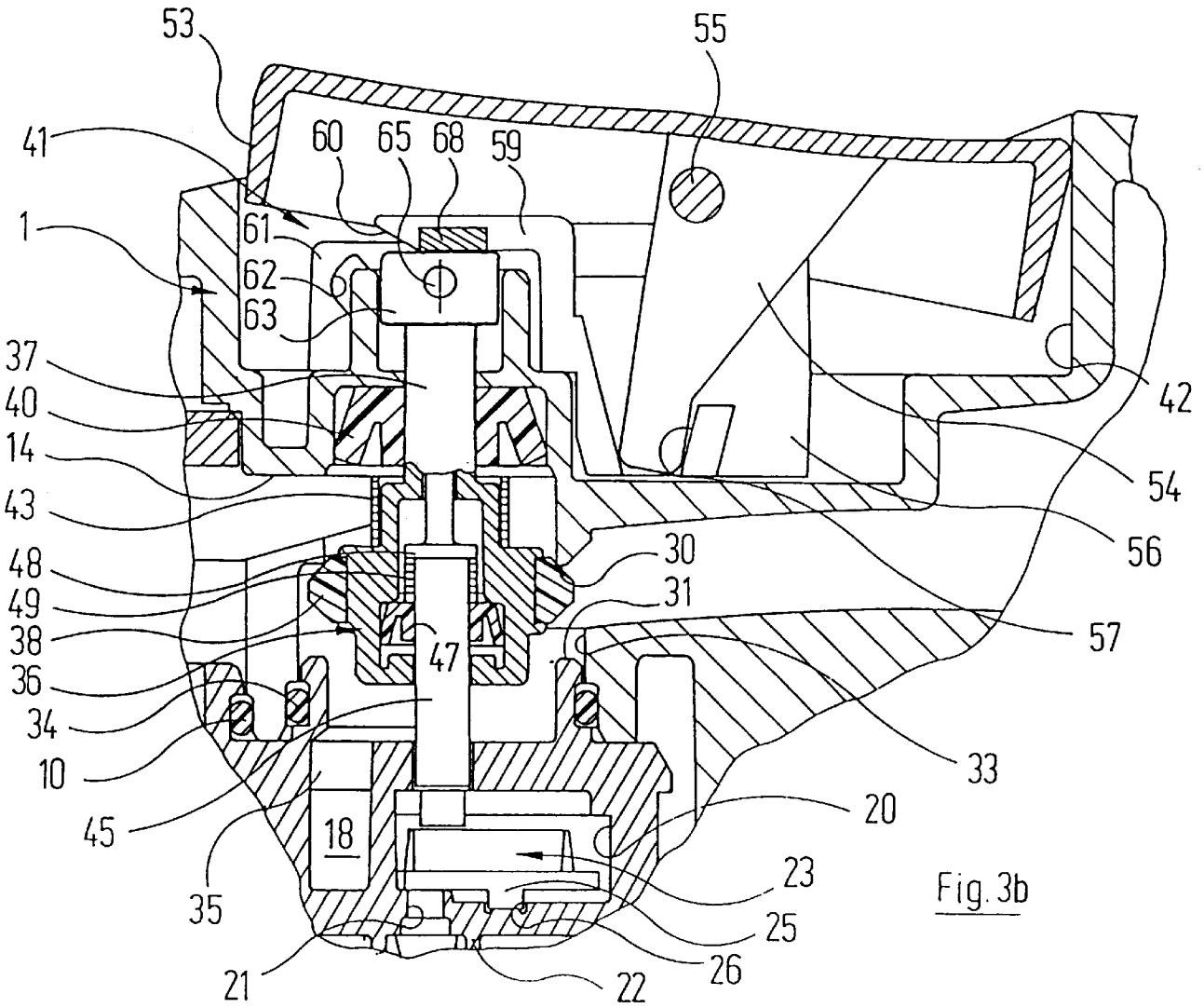
Figure 3C:
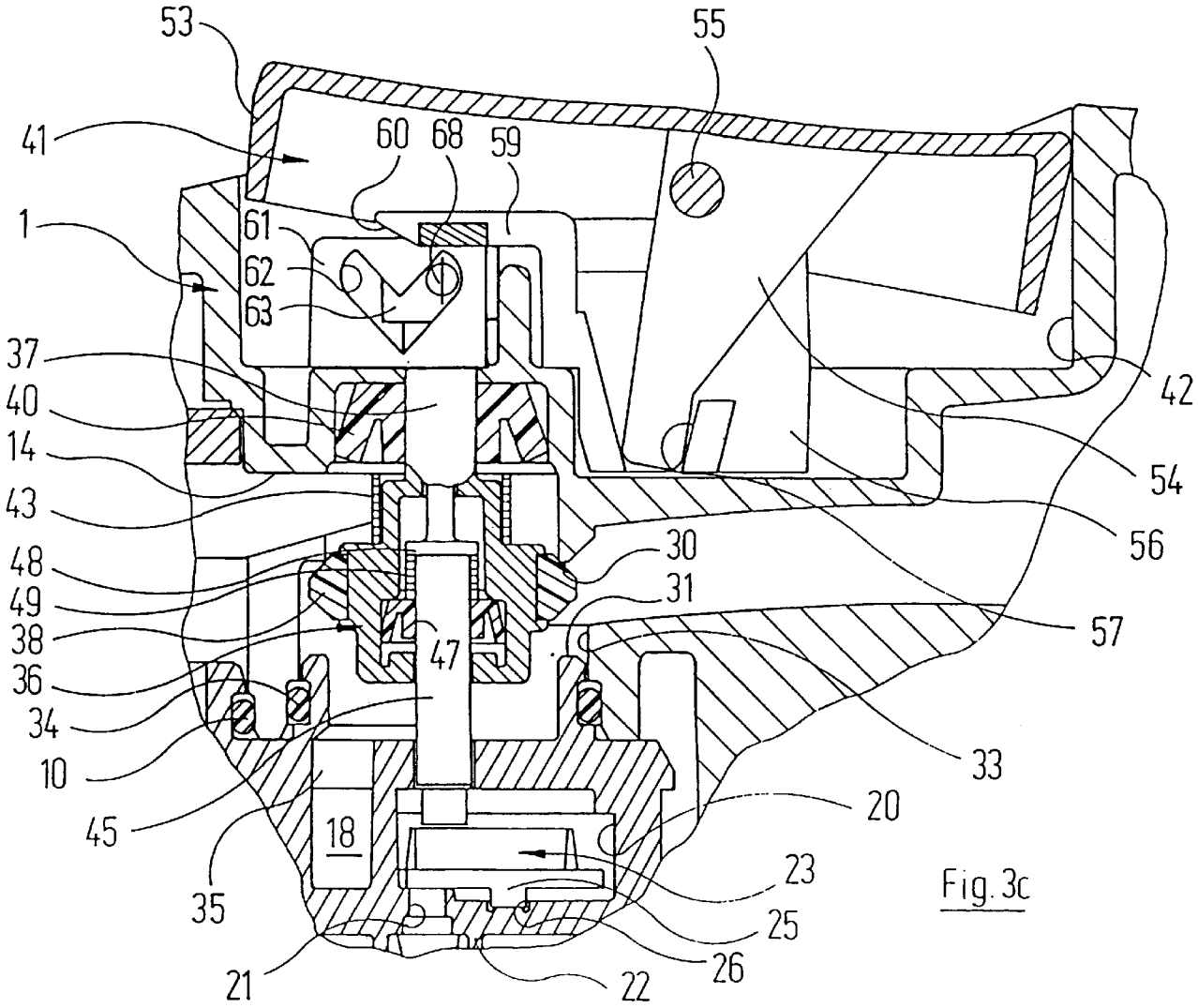
Figure 4A:
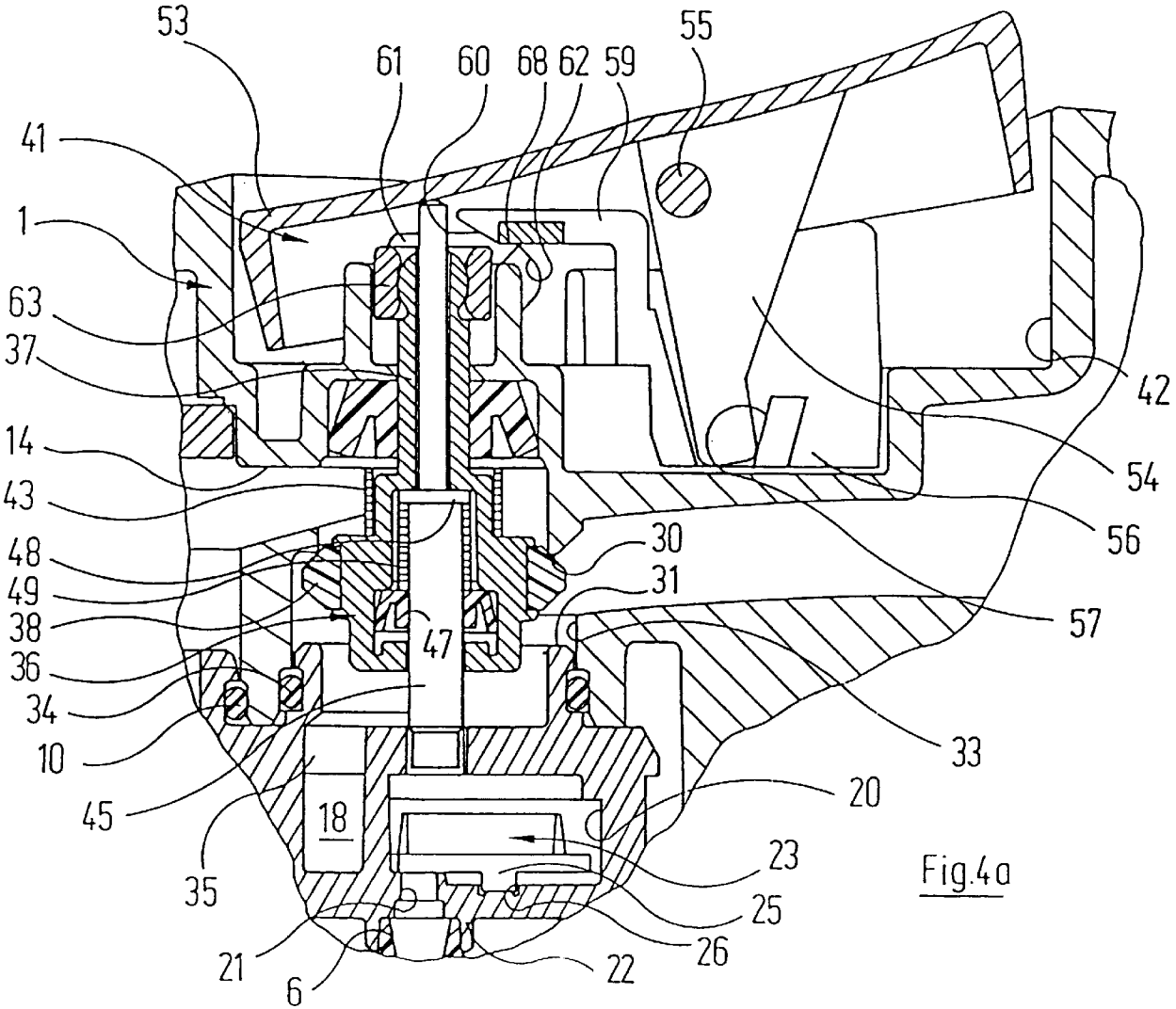
Figure 4B:
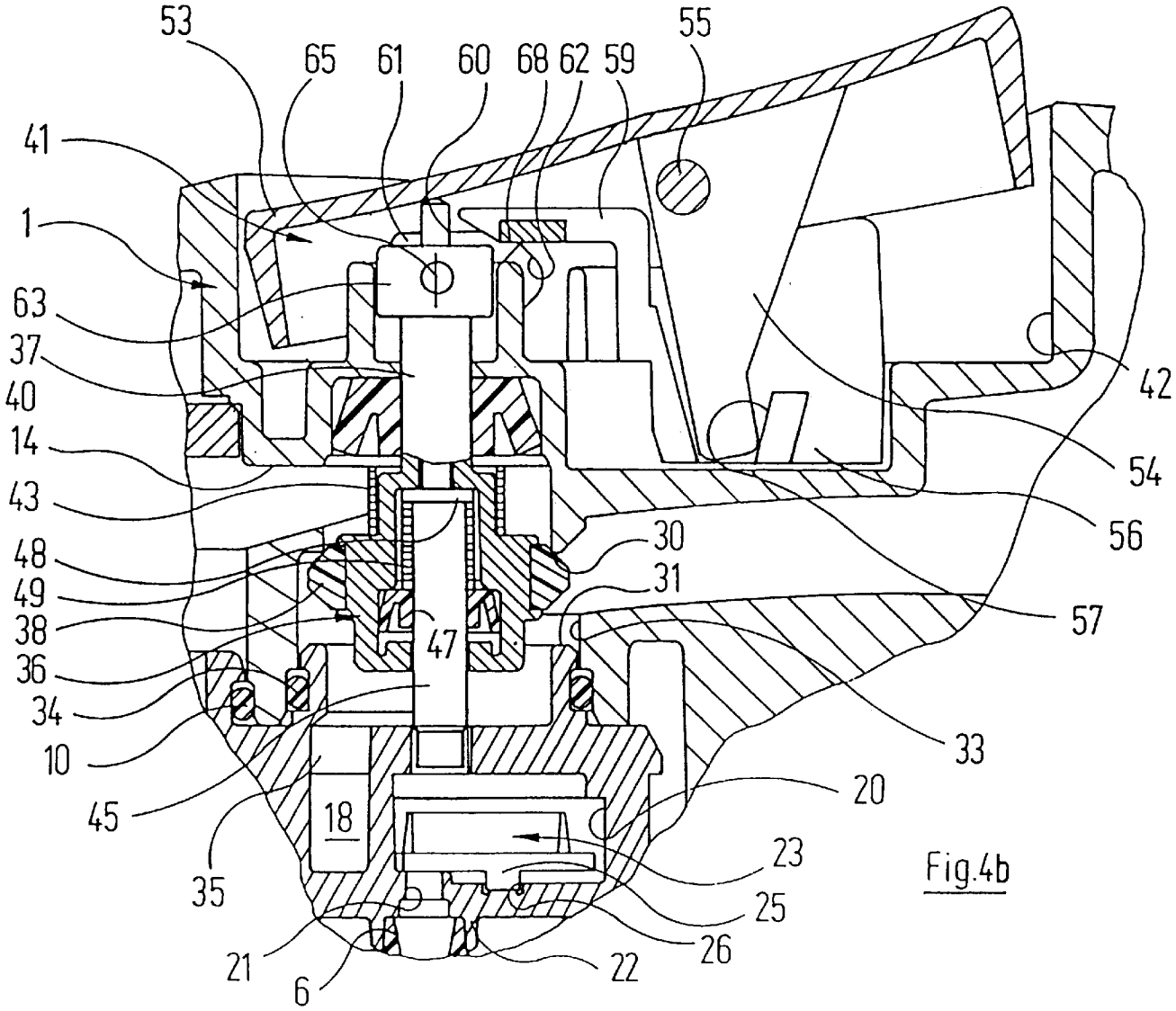
Figure 4C:
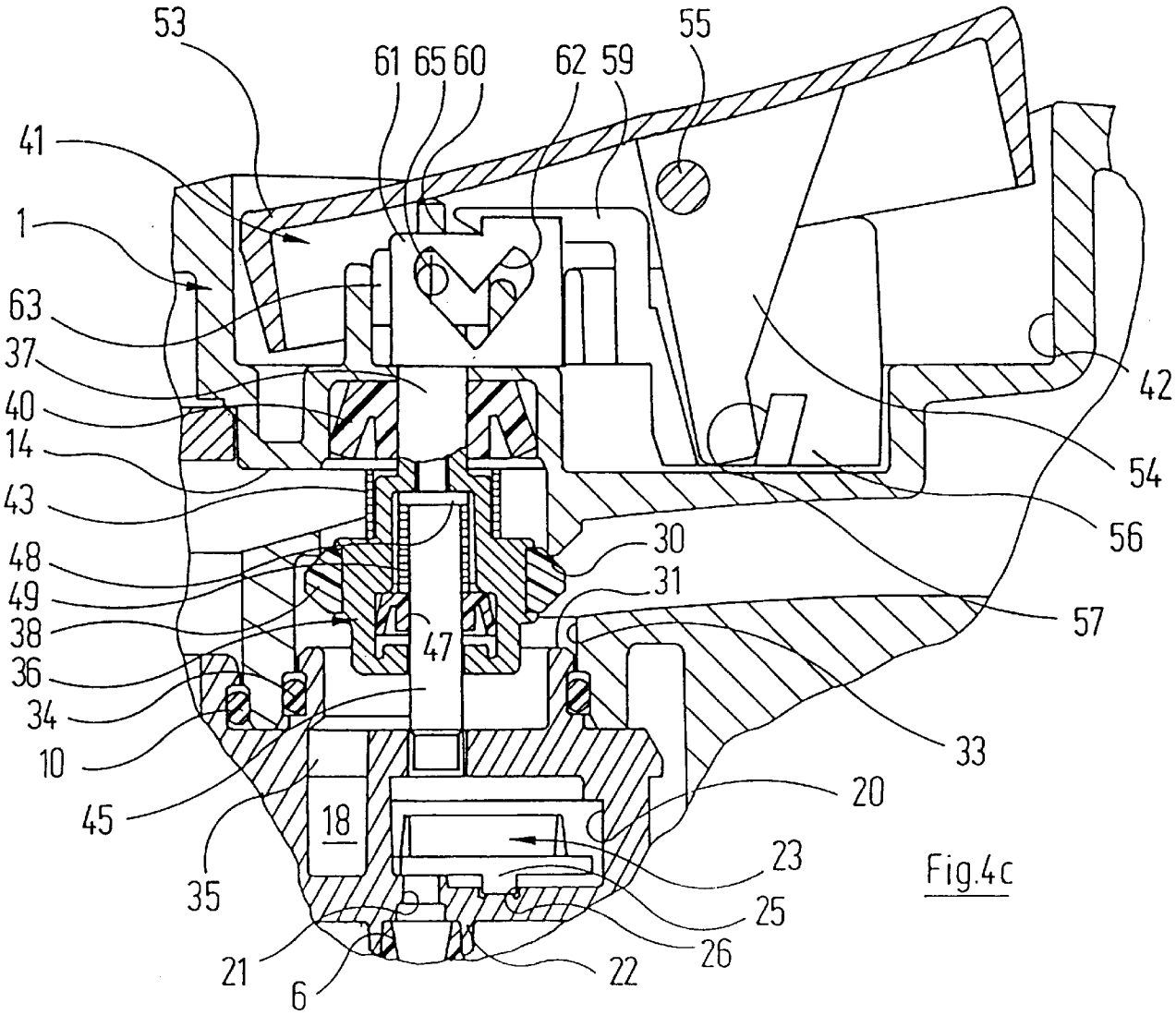
Figure 5:
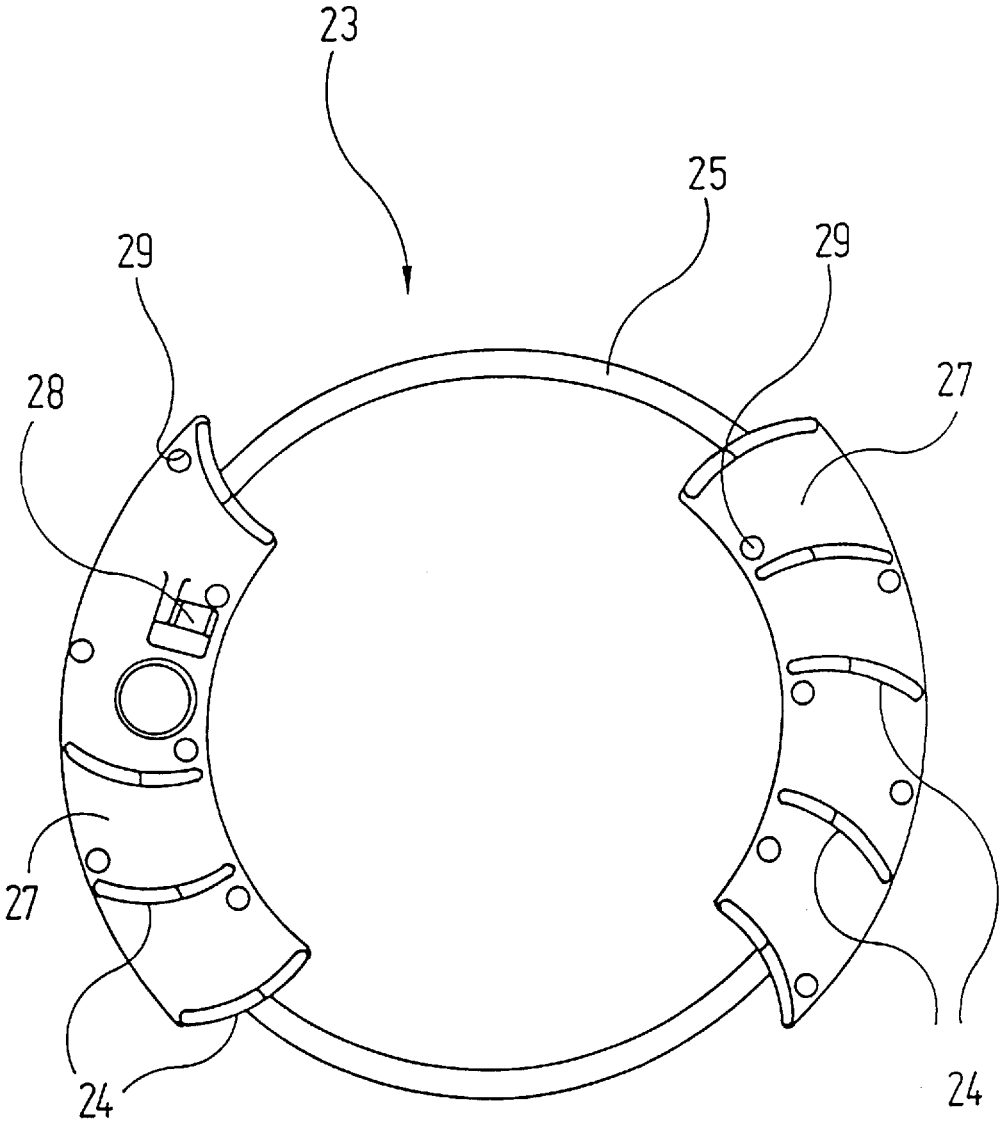

One embodiment of the invention is explained below in greater detail with the aid of the drawings:

FIG. 1: shows a section through a hand shower (hand set section not shown in full);

FIGS. 2*a* to 2*c:* show, in greater scale, a different view of sections through the change-over mechanism of the hand shower shown in FIG. 1 in a first mode of operation;

FIGS. 3*a* to 3*c:* show sections, similar to those shown in FIGS. 2*a* to 2*c,* in a second mode of operation;

FIGS. 4*a* to 4*c:* show sections, similar to those shown in FIGS. 2*a* to 2*c,* in a third mode of operation of the hand shower;

FIG. 5: shows a plan view of the pulse wheel contained in the hand shower illustrated in FIG. 1.

FIG. 1 shows a section through the complete hand shower, with the aid of which the various internal water channels for the different modes of operation of the hand shower can first of all be explained. The hand shower illustrated actually consists, in the known manner, of a housing 1 which has a bell-shaped extension in the area 1*a* to the left of the drawing and which, as shown in the right of FIG. 1, merges into a hand set 1*b* which is shown largely incomplete. The hand set 1*b* is hollow; its internal chamber 2 is used to supply the water, as is generally the norm in hand showers.

The bell-shaped extended area 1*a* of the housing 1 is sealed at the bottom by a shower base 3. In the embodiment illustrated, this is made up of an outer layer 3*a* made of an elastomer material which acts as an impact protection plate and an inner, rigid layer 3*b*. The shower base 3 has two sets of water outlet openings 4, 5 which are arranged in concentric circles about the centre axis of the shower base 3. The water outlet openings 4 have a relatively small cross-section; they are located at the outer end of a tubular jet insert 6 which extends quite a long way into the internal chamber of the housing 1. This jet insert 6 is also made of an elastomer material.

In a corresponding manner the water outlet openings 5, which have a relatively large cross-section, are located at the outer end of tubular jet inserts 7 which extend only a relatively short way inside the inner chamber of the housing 1. The tubular jet inserts 7 are also made of an elastomer material.

An insert 8 is secured inside the bell-shaped area 1*a* of the housing 1. This is a relatively complicated preform which is actually shown in the drawing as a single piece, but which in actual fact is usually made up of several parts. The insert 8 can roughly be divided into an area 8*a*. which runs parallel to the shower base 3 and an essentially cylindrical insert 8*b* which extends upwards from the back of this area 8*a* shown in FIG. 1. The cylindrical insert 8*b* is inserted into a cylindrical wall 9 preformed on to the housing 1, is sealed against this by means of an O-ring; 10 and is secured in an appropriate manner—for example by gluing or by means of a catch (not shown)—in an axial direction to the shower base 3.

The shower base 3 is attached to the insert 8 and thus to the housing 1 by means of a central fixing screw 11 which is screwed into a central graduated hole 12 in the insert 8.

Several circular chambers are moulded into the insert 8:

A first circular chamber 13 is located inside the cylindrical insert 8*b*. It is linked to a radial through hole 14 in the circular wall 9 of the housing facing towards the hand set 1*b*.

The circular chamber 13 is also connected via a number of through holes 15 provided in its circular base to a second circular chamber 16 which opens on to a water distribution chamber 17 parallel to the shower base 3 and which essentially extends over its entire surface. The water distribution chamber 17 is connected to the inside ends of the tubular jet inserts 7 which are part of the larger cross-section water outlet openings 5.

There is recessed in the area 8*a* of the insert 8 which extends parallel to the shower base a third circular chamber 18 which is connected, via several through holes 19 spaced over the circumference, to a fourth circular chamber 20. The fourth circular chamber 20 goes concentrically round the third circular chamber and has a larger radius.

There are provided in the base of the fourth circular chamber 20 and coaxial to each tubular jet insert 6 through holes 21 which have small cylindrical collars 22 around their outside end which are moulded on to the underside of the insert 8. The cylindrical collars 22 receive the inside ends of the tubular jet inserts 6; owing to the flexible properties of these tubular jet inserts 6 a leakproof transfer of the water from the fourth circular chamber 20 to the water outlet openings 4 with the small cross-section is thus guaranteed.

There is pivot mounted in the fourth circular chamber a pulse wheel 23 which—as can be seen especially in FIG. 5—is equipped with a number of curved turbine blades 24 which essentially extend radially.

The pulse wheel 23 is controlled by means of a circular rib 25 which is preformed in one piece and which runs in a groove 26 in the bottom of the fourth circular chamber 20.

The rib 25 on the pulse wheel 23 carries two diametrically opposite covering ring segments 27 each of which extend over an angle of approximately 90° parallel to the base of the fourth circular chamber 20 and cover the through holes 21 in the appropriate peripheral area of the circular chamber 20. There is also preformed on to one of the covering ring segments 27 between the turbine wheels 24 a stop 28 which overhangs these axially. This is used to obstruct the pulse wheel 23 in a specific position of rotation in a manner yet to be described. There are also a number of small through holes in the covering ring segments 27 each of which, in the aforementioned stopped position of the pulse wheel, line up with the through holes 21 in the insert 8.

A first valve seat 30 which faces axially downwards is formed in the housing 1 of the hand shower between the internal chamber 2 of the hand set and the through hole 14.

A second valve seat 31 is located coaxially to the first valve seat 30 on a cylindrical collar 32 on the insert 8, which goes into a complementary opening 33 in the housing 1 and is sealed against this by means of an O-ring.

The second valve seat is connected to the third circular chamber 18 via through holes 35.

The two valve seats 30 and 31 act in combination with a two-way valve cone 36 which has axial movement and which consists of a shaft part 37 and the actual seal 40 which acts in combination with the valve seats 30 and 31. The shaft part 37 of the two-way valve cone 36 is brought out of the housing 1 through an opening 39 and a shaped seal 40 fitted between the surface of the shaft part 37 and a corresponding wall of the housing prevents water from leaking from the inner chamber of the housing 1. The outside end of the shaft part 37 is connected to a change-over mechanism—the entire mechanism carrying the reference number 41—and is sometimes housed in a recess 42 at the top of the housing 1 and is described in greater detail below.

The two-way valve cone 36 is loaded by a compression spring 43 which is tensioned between one graduation of the shaft part 37 and a shim 44 supported on the housing 1 in such a way that the seal 38 on the two-way valve cone is normally in the position shown in FIG. 1, that is to say that it seals the second valve seat 31.

The entire two-way valve cone 36 has a stop rod 45 going coaxially through it. The bottom end of this stop goes through a hole 46 which leads into the fourth circular chamber. A shaped seal 47 which is inserted between the surface of the stop rod 45 and an inner cavity in the two-way valve cone 36 prevents any leakage of water from the fourth circular chamber 20.

The stop rod 45 can be moved axially inside the two-way valve cone 36. It can adopt two positions: in the first position, which is shown in FIG. 1, the bottom end of the stop rod 45 extends so far into the fourth circular chamber that it is in the path of movement of the stop 28 on the pulse wheel 23. When the stop 28 reaches the bottom end of the stop rod 45 the through holes 29 in the covering ring segment 27 are aligned with the through holes 21 in the insert 8.

In the second axial position, the stop rod 45 is moved so far upwards that its bottom end is no longer in the path of movement of the stop 28 on the pulse wheel 23 and therefore the pulse wheel 23 is able to rotate completely freely.

A compression spring 49 which is tensioned between a beading 48 going round the stop rod 45 and the top of the shaped seal 47 forces the stop rod 45 upwards inside the two-way valve cone 36.

Before going into any further description of the change-over mechanism 41 which can be used to control the positions of both the two-way valve cone 36 and also the stop rod 45, it would appear to be expedient to describe the three modes in which the hand shower illustrated can be operated. An understanding of these modes of operation will then make it easier to appreciate the role of the change-over mechanism 41.

The first mode of operation of the hand shower is shown in FIG. 1 and also in FIGS. 2*a* to 2*c*. In this mode, the second valve seat 31 is closed by the two-way valve cone 36. The water flowing through the inner chamber 2 of the hand set 1*b* flows past the first valve seat, through the opening 14 in the wall 9 of the housing 1, into the first circular chamber 13 in insert 8*b*. From there, the water continues to flow through the openings 15 into the second circular chamber 16, then into the water distribution chamber 17 and then out via a circular screen 50 which covers the inner ends of the tubular jet inserts 7.

As it enters the second circular chamber 16, the water flowing through the openings 15 in the form of numerous single jets is enriched with air which is drawn in via the radial holes 51 linking the circular chamber 16 with the centre graduated hole 12, the graduated hole 12 itself and also through holes 52 in the shower base 3. The water which flows out of the water outlet openings 5 is therefore enriched with tiny air bubbles. Owing to the relatively large cross-section of the water outlet openings 5, the shower jets produced in this mode are comparatively slow. They are therefore perceived as being soft. In the profession this is therefore referred to as "soft jet mode".

The second mode of operation of the shower is obtained when the two-way valve cone 36 is moved upwards, thereby obstructing the first valve seat 30 and freeing the second valve seat 31. The stop rod 45 on the other hand is still in the position where its bottom end prevents the pulse wheel 23 from rotating freely. The positions are illustrated in FIGS. 3*a* to 3*c*.

In this mode of operation the water flowing through the inner chamber 2 in the hand set 1*b* flows through the openings 35 in the insert 8 into the third circular chamber 18 and from there it flows through the radial holes 19 into the fourth circular chamber 20. If the stop 28 on the pulse wheel 23 is not yet at the bottom end of the stop rod 45 the pulse wheel will turn a little due to the turbine blades 24 until it hits the stop 28 on the stop rod 45. The pulse wheel 23 is then no longer able to rotate further. The fourth circular chamber 20 now acts as a simple water distribution chamber from which the water flows through the openings 21 in the base of the fourth circular chamber 20 and the tubular jet inserts 6 to the water outlet openings 4. The jets of water which emerge from these are comparatively fast owing to the geometry of the water outlet openings 4 and for this reason, and also because they have not been enriched with air, they are perceived as being hard. This mode is therefore referred to as the "hard jet mode" of the hand shower.

In the third mode of operation of the hand shower, the two-way valve cone 36 has the same position as in the second mode of operation: this means that it obstructs the first valve seat 30 and frees the second valve seat 31. The stop rod 45 on the other hand is now withdrawn axially upwards with the result that its bottom end no longer prevents the pulse wheel 23 from turning. The path the water takes is the same as in the second mode of operation: the water flows through the inner chamber 2 in the hand set 1*b*, past the second valve seat 31, through the openings 35 into the third circular chamber 18 and from there it flows through the radial openings 19 into the fourth circular chamber 20 and from this through the holes 21 and the tubular jet inserts 6 to the water outlet openings 4 which have a small cross-section. Since, however, the bottom end of the stop rod 45 is now no longer in the path of movement of the stop 28 on the pulse wheel 23, this is now set in rotation by the water flowing on to the turbine blades 24. The covering ring segments 27 which form part of the pulse wheel now rotate over the holes 21, alternately freeing them and then closing them again. As a result, the hard jets emerging from the water outlet openings 4 are also periodically interrupted and therefore they "pulse". This is therefore referred to as either "pulse jet mode" or "massage jet mode".

The change-over mechanism 41 and its interaction with the two-way valve cone 36 and also the stop rod 45 will now be described below in greater detail, that is to say the mode and manner in which the two-way valve cone 36 and the stop rod 45 are moved in order to bring about the three modes of operation. In this regard, reference is first of all made to FIGS. 2*a* to 2*c*.

As illustrated in these figures, the part of the change-over mechanism 41 which is housed in the recess 42 in the housing 1 consists of a rocker-type manual actuator 53, hereinafter abbreviated to "rocker". The rocker 53 closes the recess 42 of the housing 1 at the top and overlaps only far enough to allow it to be easily operated. An actuating finger 54 which projects into the recess 42 is moulded on to the rocker 53. It has a swivel pin 55 which goes through its upper area and is retained in the side walls of the housing 1. In this way, the rocker can be turned about a horizontal axis defined by the swivel pin 55.

The bottom end of the actuating finger 54 engages in a guide recess 57 in a slide 56. By virtue of a suitable configuration of its side wall and the adjacent wall of the housing, the slide 56 is contained inside the recess 42 and can be moved in the direction of the double arrow. By pressing the rocker 53, the arrangement obviously allows by the slide 56 to be moved linearly inside the recess 42 and in actual fact between three positions which correspond to the three modes of operation of the hand shower as described above. FIGS. 2*a* to 2*c* show the centre position of both the rocker 53 and also the slide 56 corresponding to the first mode of operation of the hand shower, that is to say the "soft jet mode".

There is preformed on to the top of the slide 56 an arm 59 which runs approximately parallel to the direction of the arrow 58 and which has an inclined cam surface 60 at its end.

A guide plate 61 with a V-shaped guide slot 62 in it is preformed on to both sides of the arm 59 on the slide 56 only the guide plate 61 which is behind the drawing plane can be partly recognised in FIGS. 2*a* and 2*b*. The front guide plate 61 is not shown, in line with the section. The interface is marked by the hatched rectangle 68. The view shown in FIG. 2*c* is, however, different in the area at the top end of the two-way valve cone 36 and therefore the guide plate 61 which is actually in front of the sectional plane and the manner in which it is connected to the arm 59 of the slide 56 can be identified.

The top end of the shaft part 37 is spherical in shape, as can be seen particularly from FIG. 2*a*. It fits into a complementary partially spherically shaped inner surface of a guide ring 63 which consists of two parts. The guide ring 63 is contained in a cylindrical collar 64 which is preformed on to the base of the recess 42 in the housing 1 and has axial movement.

Two guide pins 65 project from the shell surface of the guide ring 63, diametrically opposite and perpendicular to the drawing plane, as can be seen from FIGS. 2*b* and 2*c*. The guide pins 65 are accommodated in the guide slots 62 of their respective adjacent guide plates 61. This can be seen especially from FIG. 2*c*.

In the first mode of operation, that is to say in the "soft jet mode", the relative position of the slide 56 and especially the V-shaped guide slots 62 in the guide plates 61 in respect of the top end of the two-way valve cone 36 is such that the guide pins 65 are located in the bottom apex of the V-shaped guide slots 62. This is shown in FIG. 2*c*. The position in which the two-way valve cone 36 is able to adopt the bottom-most position in which its seal 38 closes the second valve seat 31 can be seen. Owing to the inner positive closure between the shaft part 37 of the two-way valve cone 36 and the stop rod 45, the latter is also in its bottom-most position, in which its bottom end therefore extends into the fourth circular chamber 20. The top end of the stop rod 45 is a short distance away, opposite the cam surface 60 on the arm 59 of the slide 56.

Let us now assume that the hand shower is required to be changed from the first mode of operation shown by FIGS. 2*a* and 2*c* into the second mode of operation in which hard jets emerge from the water outlet holes 4 in the shower base 3 in an unpulsed, that is to say an unbroken mode. To achieve this the rocker 53 is pressed in the area to the right of the swivel pin 55 as shown in FIGS. 2*a* to 2*c* such that the actuating finger 54 turns clockwise. Starting from the relative positions shown in FIGS. 2*a* to 2*c,* the relative positions are now reached which are shown in FIGS. 3*a* to 3*c*.

First of all, it can be seen from FIG. 3*a* that the underside of the arm 59 on the slide 56 has been pushed over the top end of the stop rod 45. The s top rod is therefore still not able to move out of the axial position in which its bottom end obstructs the pulse wheel 23.

This is not the case, how-ever, with the two-way valve cone 36: as can be seen especially from FIG. 3*c,* the guide pins 65 on the guide ring 63 are forced by the linear movement of the slide 55 to the left into the right-hand side of the V-shaped guide slot 62 as shown in the drawing. Owing to the inclined position of this side, the guide pins 65 are drawn upwards in a kind of cam action; owing to the positive closure between the guide ring 63 and the shaft part 37 of the two-way valve cone 36, the latter follows, moving axially upwards until it obstructs the first valve seat 30 as shown in FIGS. 3*a* and 3*c*. Given, as already mentioned, that the stop rod 45 stops axially with this axial movement of the two-way valve cone 36, the compression spring 49 mounted between the two-way valve cone 36 and the stop rod 45 is consequently compressed. The circumstances are obviously as required for the second mode of operation: the water is able to flow past the second valve seat 31 through the third circular chamber into the FOURTH circular chamber 20 and from there flows to the water outlet openings 4, but the stop rod 45 still prevents the pulse wheel 23 from rotating.

The third mode of operation in which pulsed hard jets emerge from the water outlet openings 4 from the "centre position" of the rocker 53 and slide 56 shown in FIGS. 2*a* to *2c* is obtained by the user pressing the rocker 53 to the side which is to the left of the swivel pin 55 as shown in the drawing. The actuating finger 54 on the rocker 53 now turns anticlockwise and moves the slide 56 from the position shown in FIGS. 2*a* to 2*c* to the right. The relative positions of the various parts are shown in FIGS. 4*a* to 4*c*.

With regard to the axial position of the two-way valve cone 36, the circumstances are obviously completely identical to those described in the second mode of operation which is shown in FIGS. 3*a* to 3*c*. The only difference is that the guide pins 65 of the guide ring 63 are now pushed into the left-hand side of the guide slot as shown in drawing. The lifting movement of the guide ring 63 and therefore the entire two-way valve cone 36 is, however, produced by virtue of the cam action, in completely the same way as it is in the second mode of operation. In this respect, as can be seen, the circumstances for any movement out of the "centre position" shown in FIGS. 2*a* to 2*c* are symmetrical to the right and to the left.

The position is, however, different with regard to the stop rod 45:

By moving the slide 56 to the right vis-a-vis FIGS. 2*a* to 2*c,* as shown especially in FIGS. 4*a* and 4*b,* the top end of the stop rod 45 ends up outside the range of the arm 59 of the slide 56. The stop rod 45 is now pushed upwards by the action of the compression spring 49, following the movement of the two-way valve cone 36, with the result that the bottom end of the stop rod 45 moves upwards out of the fourth circular chamber 20 and frees the movement of the pulse wheel 23. The conditions are now obviously as required for the third mode of operation: the water flows past the second valve seat 31 and through the third circular chamber 18 into the fourth circular chamber 20 where it is able to set the pulse wheel 23 to rotate freely. The desired pulsed hard jets (pulse or massage jets) now emerge from the water outlet openings 4 in the shower base 3.

In the embodiment described above, the change-over from "hard jet mode" to "pulse jet mode" is carried out with the aid of a change-over device in the form of a stop rod 45, with which the rotation of the pulse wheel is stopped. In a second embodiment, not shown in the drawing, the second change-over device acts on a second two-way valve cone, by means of which the water can be directed to two different water channels—either to the one appropriate for the "hard jet mode" or to the one for the "pulse jet mode". The second change-over device in this embodiment also moves in the manner described above.

As soon as the water supply is shut off, the compression spring 43 returns the two-way valve cone 36 into the position shown in FIGS. 2*a* to 2*c,* which then becomes the preferred position. The first mode of operation is therefore automatically set with the result that the shower operates in the "soft jet mode" when the water supply is turned on again.

It is, of course, possible to incorporate appropriate design measures to make the positions corresponding to FIGS. 3 or 4 the "preferred positions" which are automatically set when the water is first turned on, or—as described above—when the water is shut off.

I claim:

1. Multifunction hand shower in which at least three different modes of operation can be selected in which different types of shower jets emerge, comprising a) a housing;

b) a shower base which seals the housing and which has numerous water outlet openings;

c) a change-over mechanism to select the mode of operation which consists of:

ca) a manual actuator;

cb) at least one change-over device, controlled by the manual actuator, which can be moved into at least two different positions and in this way determines the mode of operation of the shower, characterized in that the change-over mechanism consists of:

cc) a slide (56) which is contained in the housing (1) and can be moved translationally or rotationally by the manual actuator (53) and which can be set in three different positions corresponding to the modes of operation of the hand shower;

cd) a first change-over device (37, 63) which can be moved by the slide (56) via a guide and cam mechanism (61, 62, 65) into two different positions, the first of which is adopted in the first mode of operation and the second in the two other modes of operation;

ce) a second change-over device (45) which can be set in two different positions and is pushed into one of these positions by a spring (49), whereby cf) the slide (56) has a stop (59, 60) which in one position of the slide (56) holds the second change-over device (45) against the force of the spring (49) in the first position and in a second position of the slide (56) allows the spring (49) to force the second change-over device (45) into the second position.

2. Hand shower according to claim 1, characterized in that the first change-over device (37) acts on a two-way valve cone (36) which works in combination with two valve seats (30, 31) formed in the housing (1).

3. Hand shower according to claim 2, characterized in that the second change-over device also acts upon an additional two-way valve cone which acts in combination with a third and a fourth valve seat formed in the housing.

4. Hand shower according to claim 3, characterized in that the side of the third and fourth valve seat sited upstream is connected to the side of the first or second valve seat sited downstream.

5. Hand shower according to claim 1 in which in one mode of operation a pulse wheel which is pivot mounted in the housing periodically interrupts and frees the emerging water jets, characterized in that the second change-over device (45) acts on a stop part which in one of the two positions of the second change-over device (45) is outside the path of movement of a stop (28) mounted on the pulse wheel (23) and in the other of the two positions of the second change-over device (45) is in the path of movement of the stop (28) on the pulse wheel (23), such that the pulse wheel (23) is halted in a specific position of rotation.

6. Hand shower according to claim 1, characterized in that both change-over devices (37, 45) can move parallel to each other and perpendicular to the direction of movement of the slide (56).

7. Hand shower according to claim 6, characterized in that the second change-over device (45) is contained coaxially inside the hollow first change-over device (37).

8. Hand shower according to claim 1, characterized in that the manual actuator (53) is a rocker which can be pivoted from a centre first position into a second position and into a third position.

9. Hand shower according to claim 8, characterized in that there is preformed on to the rocker (53) an actuating finger (54) which engages in a guide recess (57) in the slide (56).

10. Hand shower according to claim 1 characterized in that the guide and cam mechanism (61, 62, 65) operates symmetrically relative to the centre position of the slide (56), whereas the stop (59, 60) on the slide (56) operates asymmetrically relative to the centre position of the slide (56) in the sense that it prevents the movement of the second change-over device (45) into the second position only in one out-of-centre position of the slide (56).

11. Hand shower according to claim 10, characterized in that the guide and cam mechanism (61, 62, 65) consists of:

a) two guide slots (62) arranged parallel to each other on the slide (61);

b) two guide pins (65) which project from the first change-over device (37, 63) on diametrically opposite sides and each of which engages in one of the two guide slots (62).

12. Hand shower according to claim 1, characterized in that the guide and cam mechanism (61, 62, 65) consists of:

a) at least one guide slot (62) on the slide (56);

b) at least one guide pin (65) which is connected to the first change-over device (37) and which engages in the guide slot (62).

13. Hand shower according to claim 12, characterized in that each guide slot (62) is V-shaped.

14. Hand shower according to claim 1, characterized in that the first change-over device (37, 63) consists of:

a) a shaft part (37) with a partially spherical head;

b) a guide ring (63) with a partially spherical interior space in which the partially spherical head of the shaft part (37) is received so that it is form fit but can be pivoted.

15. Hand shower according to claim 1, characterized in that the stop on the slide (56) is formed by an arm (59) projecting out of the slide (56) perpendicular to the direction of movement of the second change-over device (45).

16. Hand shower according to claim 15, characterized in that a cam surface (60) which is set at an angle to the direction of movement of the slide (56) is mounted on the free end of the arm (59).

* * * * *